US005800202A

United States Patent [19]

Tsuji et al.

[11] Patent Number: 5,800,202

[45] Date of Patent: Sep. 1, 1998

[54] ELECTRICAL CONNECTOR ASSEMBLY WITH COUPLING GUIDE STRUCTURE

[75] Inventors: Masanori Tsuji; Haruki Yoshida, both of Shizuoka, Japan

[73] Assignee: Yazaki Corporation, Tokyo, Japan

[21] Appl. No.: 661,326

[22] Filed: Jun. 13, 1996

[30] Foreign Application Priority Data

Jun. 19, 1995 [JP] Japan ..... 7-151796
Apr. 19, 1996 [JP] Japan ..... 8-098694

[51] Int. Cl.[6] ..... H01R 3/00

[52] U.S. Cl. ..... 439/489; 439/347

[58] Field of Search ..... 439/489, 488, 439/347, 352, 353, 357, 358, 350

[56] References Cited

U.S. PATENT DOCUMENTS 5,338,219 8/1994 Hiramoto et al. ..... 439/350
5,348,493 9/1994 Power ..... 439/350

*Primary Examiner*—Khiem Nguyen
*Assistant Examiner*—Yong Ki Kim
*Attorney, Agent, or Firm*—Armstrong, Westerman, Hattori, McLeland & Naughton

[57] ABSTRACT

A first connector housing has a coupling noticing member slidably mounted therein orthogonally to the connector housing coupling direction. An operating portion is provided in one outward end of the coupling noticing member. An actuating portion is provided in the coupling noticing member and has an inwardly tapered face with a falling gradient, the tapered face being directed oppositely to the connector housing coupling direction. A second connector housing engaging with the first connector housing has a projecting guide piece provided in an opening end of the second connector housing and abutting against the tapered face of the coupling noticing member. An actuating portion inserting recess is opened adjacent to the projecting guide piece in the second connector housing. The first connector housing has a resilient lock arm with a ramped locking protrusion and the second connector housing has a stepped portion abutting against the ramped locking protrusion.

5 Claims, 13 Drawing Sheets

ELECTRICAL CONNECTOR ASSEMBLY WITH COUPLING GUIDE STRUCTURE

BACKGROUND OF THE INVENTION

1. Field of the Invention

This invention relates to an electrical connector assembly including a pair of mating connectors having an improved coupling guide structure for smoothly guiding the coupling of the connectors.

2. Description of the Prior Art

Generally, a pair of mating connectors used in electrical wiring accommodate respectively male terminals or female terminals in a plurality of terminal receiving cavities provided in connector housings. Each male terminal engages with a corresponding female terminal to electrically connect therewith along with the coupling of the connectors.

For easily confirming the coupling of the connectors, in Japanese patent application No. H. 7-22536, as shown in FIG. 18, there is proposed an electrical connector assembly K having a coupling noticing member c.

In the electrical connector assembly K, when a pair of connector housings a, b engage with each other, the coupling noticing member c having been provisionally pushed into the connector housing a moves outwardly from the connector housings with the engagement of the connector housings so that the coupling of the pair of connector housings a, b can be visibly checked.

That is, when the connector housing a advances into the connector housing b, as shown in FIG. 19, a tapered face e of an actuating portion d in the coupling noticing member c makes contact with a guiding protrusion f in the connector housing b, so that the coupling noticing member c is pushed out along with the advance of the connector housing a. After the complete engagement of the pair of connector housings a, b by pushing the coupling noticing member c into the connector housing a, the connector housing a is locked to the connector housing b, as shown in FIG. 20.

FIG. 21 is a graph showing a coupling force varying along with the engaging process of the pair of connector housings a, b. The axis of abscissas shows the coupling distance of the connector housing a to the connector housing b and the axis of ordinate shows the amount of the coupling force.

First, the connector housing a begins to engage with the connector housing b, which requires a force corresponding to a releasing force R for releasing the coupling noticing member c provisionally engaged with the connector housing a. Then, the engagement force R comes to a peak and decreases during a period.

Next, a connection force Q for connecting the male terminals to the corresponding female terminals received in the connector housings a, b is required. Then, the connection force Q increases gradually until the connection is completed.

Therefore, a worker in the coupling work can not surely confirm the complete engagement of the pair of connector housings a, b after releasing the provisional engagement of the coupling noticing member c merely by perceiving the connection force Q by his hand, which brings about an incomplete engagement of the couple of connectors or a drawback that the connector housings are partially damaged, if the engagement noticing member c is pushed into the connector housing a in the state of incomplete engagement of the connector housings.

SUMMARY OF THE INVENTION

In view of the above-mentioned drawback, an object of this invention is to provide a pair of mating connectors including respective housings having an improved coupling guide structure for smoothly guiding the coupling. The coupling guide structure provided in the connector housings can easily surely recognize the complete engagement of the pair of connectors by a coupling force peak appearing just prior to the complete engagement of the pair of connectors.

For achieving the object, this invention provides a connector assembly with a coupling guide structure including:;

- a first connector housing having a coupling noticing member slidably mounted in the first connector housing orthogonally to the connector housing coupling direction,
- an operating portion provided in one outward end of the coupling noticing member,
- an actuating portion provided in the coupling noticing member and having an inwardly tapered face with a falling gradient, the tapered face being directed oppositely to the connector housing coupling direction,
- a second connector housing engaging with the first connector housing,
- a projecting guide piece provided in an opening end of the second connector housing and mating with the tapered face of the coupling noticing member,
- an actuating portion inserting recess opened adjacent to the projecting guide piece in the second connector housing, and
- wherein the first connector housing has a resilient lock arm with a ramped locking protrusion and the second connector housing has a stepped portion abutting against the ramped locking protrusion in the resilient lock arm.

Preferably, the ramped locking protrusion has a forward tapered face and a rearward tapered face in the connector coupling direction.

Further, the coupling noticing member may have a covering portion for covering a lock portion including the ramped locking protrusion projecting for locking the first and second connector housings to each other.

Moreover, the covering portion of the coupling noticing member may have a slant outer face declined obliquely to the advancing direction of the coupling noticing member.

The coupling forces varying in the above-mentioned coupling process are shown in a graph in FIG. 11.

That is, the graph in FIG. 11 shows varying amounts of the coupling force P for coupling a pair of connector housings in an embodiment according to the present invention. The axis of abscissas shows a coupling distance of a male connector housing to a female connector housing and the right end thereof corresponds to the complete engagement state. The axis of ordinate shows the amount of the coupling force.

In FIG. 11, the peak S of the coupling force P corresponds to an actuating force for actuating the coupling noticing member 6 mounted in the male connector housing. Then, the engagement force decreases during a period and increases when the male terminals and the corresponding female terminals received in the connector housings begin to connect to each other.

As mentioned above, the coupling force P for coupling the pair of connector housings is the sum of the connection force (a dotted line T in FIG. 11) required for connecting the male terminals and the corresponding female terminals and a deflecting force (a dotted line U in FIG. 11) for deflecting a resilient lock arm when the forward tapered face of the ramped locking protrusion abuts against and is pressed by the stepped portion along with the advance of the male connector housing.

That is, P=T+U

When the male connector housing advances further into the female connector housing, the ramped locking protrusion gets over the stepped portion and the pair of connector housings engages completely with each other, and the gradually increased coupling force P decreases since the force pressing the resilient lock arm is released.

The ramped locking protrusion and the stepped portion are determined in their relative position such that the ramped locking protrusion gets over the stepped portion when the pair of connector housings have completely engaged with each other. Thereby, a worker can perceive by his hand the peak of the coupling force in the coupling process, that is, the coupling force change that the gradually increased coupling force P decreases. The recognition of the coupling force peak by his hand can surely confirm the complete engagement of the connector housings in the coupling work with ease.

Besides, when the pair of coupled connector housings are uncoupled, the rearward tapered face of the ramped locking protrusion can easily get over the stepped portion, so that the connector housings are parted from each other with no operation required for the resilient lock arm.

DETAILED DESCRIPTION OF PREFERRED EMBODIMENTS

Preferred embodiments according to the present invention will be discussed in the following.

Figure 1:
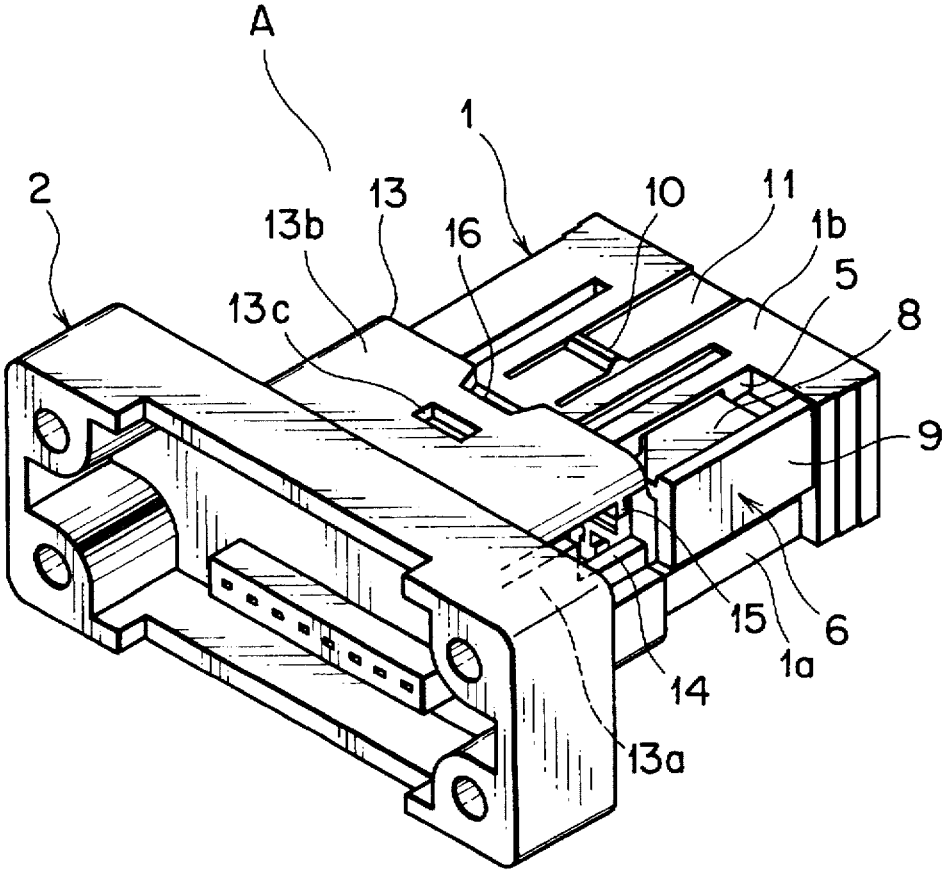
FIG. 1 is a perspective view showing an electrical connector assembly having a coupling guide structure in an embodiment according to the present invention.
Figure 2:
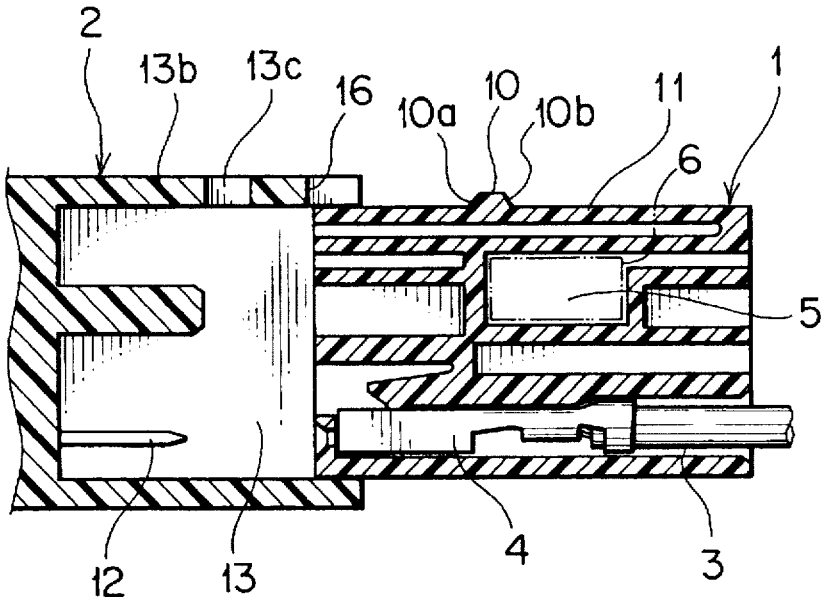
FIG. 2 is a longitudinal sectional view of the electrical connector assembly in FIG. 1.

FIG. 1 is a perspective view of an electrical connector assembly A according to the present invention, and FIG. 2 is a longitudinal sectional view of the same.

The connector assembly A is composed of a male connector housing 1 and a female connector housing 2 that are coupled to each other.

In the male connector housing 1 there are provided a plurality of terminal receiving cavities 3, each of which accommodates a female terminal 4. Further, in an upper part of the plurality of the terminal receiving cavities 3 there is disposed a coupling noticing member receiving recess 5 having an opening in a side wall 1*a* of the connector housing 1, substantially orthogonally to the connector engagement direction. In the receiving recess 5 there is slidably mounted a coupling noticing member 6.

The coupling noticing member 6 is formed with a rectangular plate-shaped sliding portion 7 (refer to FIG. 5) and a triangular plate portion 8 in a body, one end of the sliding portion 7 being provided with an operating portion 9.

On an upper wall 1*b* of the male connector housing 1 there is provided a resilient deflectable lock arm 11 having a ramped locking protrusion 10. The locking protrusion 10 is formed with a forward tapered face 10*a* in the coupling direction and a rearward tapered face 10*b* in the opposite direction.

The female connector housing 2 accommodates male terminals 12 engaging with the female terminals 4 in the connector housing 1. The connector housing 2 has a hood portion 13 receiving the male connector housing 1 in the engagement portion thereof. In a side wall 13*a* of the hood portion 13, an actuating portion inserting recess 14 for receiving an actuating portion 8 of the coupling noticing member 6 when the connectors are coupled and a projecting guide piece 15 are formed by cutting the side wall 13*a* of the hood portion 13.

In an upper wall 13*b* of the hood portion 13 there is formed a stepped portion 16 by opening a through hole 13*c* in the upper wall 13*b*.

Next, an engagement process of the male connector housing 1 and the female connector housing 2 will be discussed.

Figure 3:
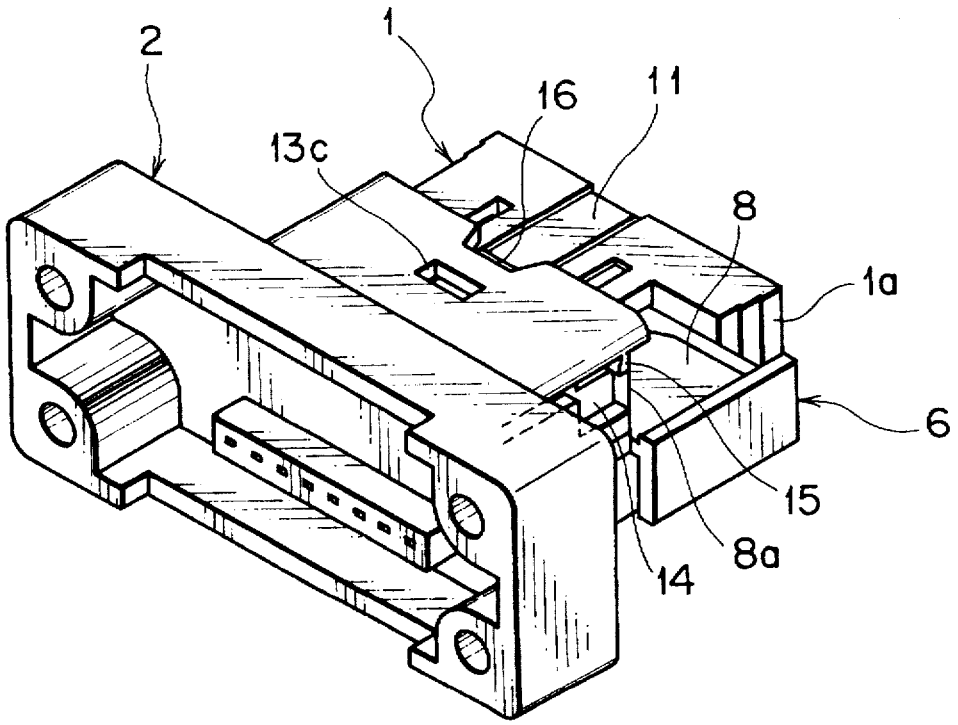
FIG. 3 is a perspective view showing an initial engagement stage of a pair of connector housings in FIG. 1.
Figure 4:
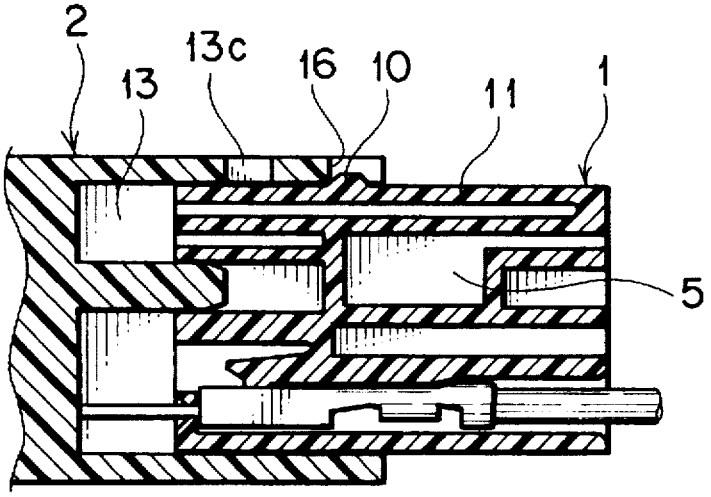
FIG. 4 is a longitudinal sectional view of the pair of connector housings in FIG. 3.
Figure 5:
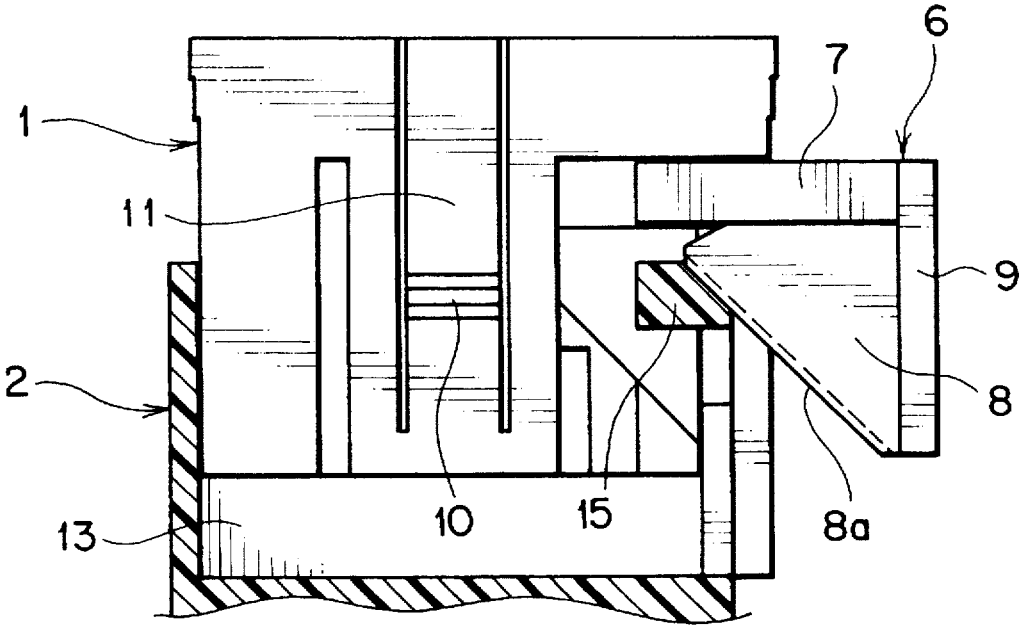
FIG. 5 is a plan of the pair of connector housings in FIG. 3.

Referring to FIGS. 3 and 4, when the male connector housing 1 enters into the hood portion 13 of the connector housing 2, the tapered face 8*a* of the actuating portion 8 in the coupling noticing member 6 abuts against the projecting guide piece 15 in the hood portion 13. As shown in FIG. 5, the advance of the male connector housing 1 pushes out the coupling noticing member 6 from the side wall 1*a* of the male connector housing 1.

At the same time, the ramped locking protrusion 10 of the resilient lock arm 11 in the male connector housing 1, as shown in FIG. 4, abuts against the stepped portion 16 in the female connector housing 2.

Figure 6:
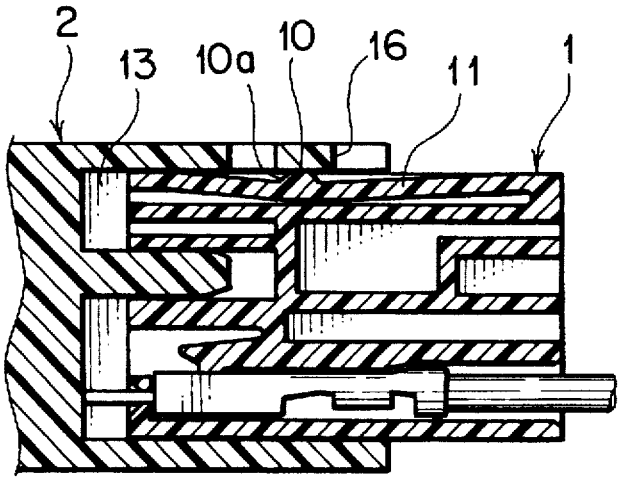
FIG. 6 is a longitudinal sectional view of the pair of connector housings in FIG. 4, in which a resilient lock arm has deflected by an advanced engagement in the pair of connector housings.

When the male connector housing 1 advances further, as shown in FIG. 6, the forward tapered face 10*a* of the ramped locking protrusion 10 is pressed by the stepped portion 16, so that the resilient lock arm 11 is bent to deflect downward.

Figure 7:
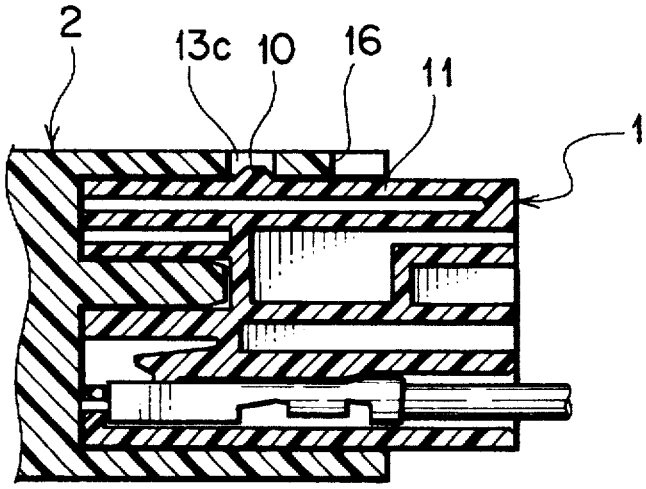
FIG. 7 is a longitudinal sectional view of the pair of connector housings in FIG. 6, in which the engagement is completed.

When the male connector housing 1 advances moreover, as shown in FIG. 7, the ramped locking protrusion 10 of the resilient lock arm 11 gets over the stepped portion 16 to be locked in the hole 13*c* and at the same time, the pair of connector housings 1, 2 engages completely with each other.

Figure 8:
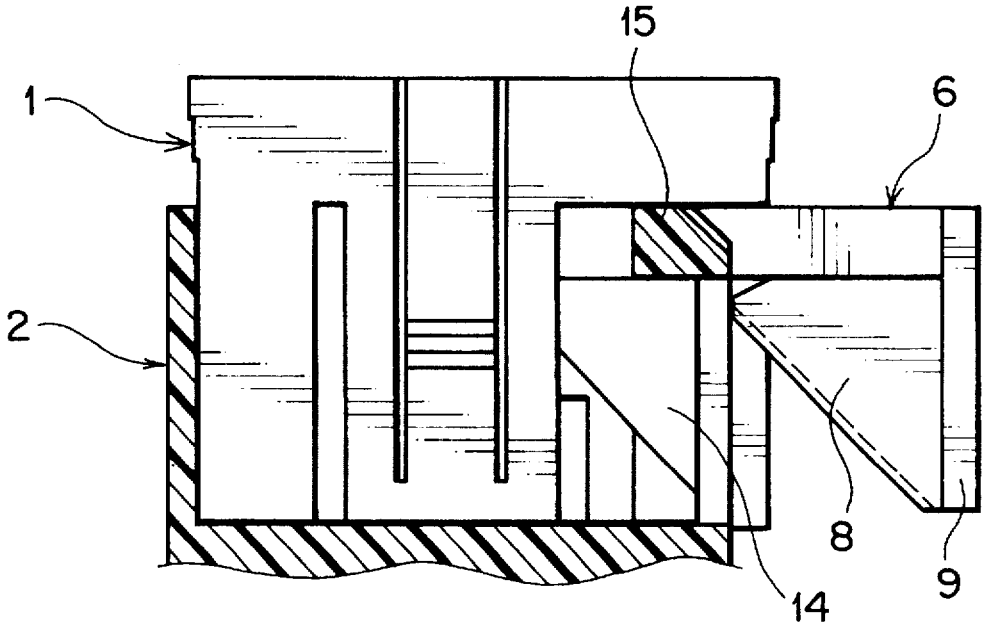
FIG. 8 is an explanatory illustration showing the state that a coupling noticing member has been drawn out when the pair of connector housings in FIG. 7 has engaged completely with each other.
Figure 9:
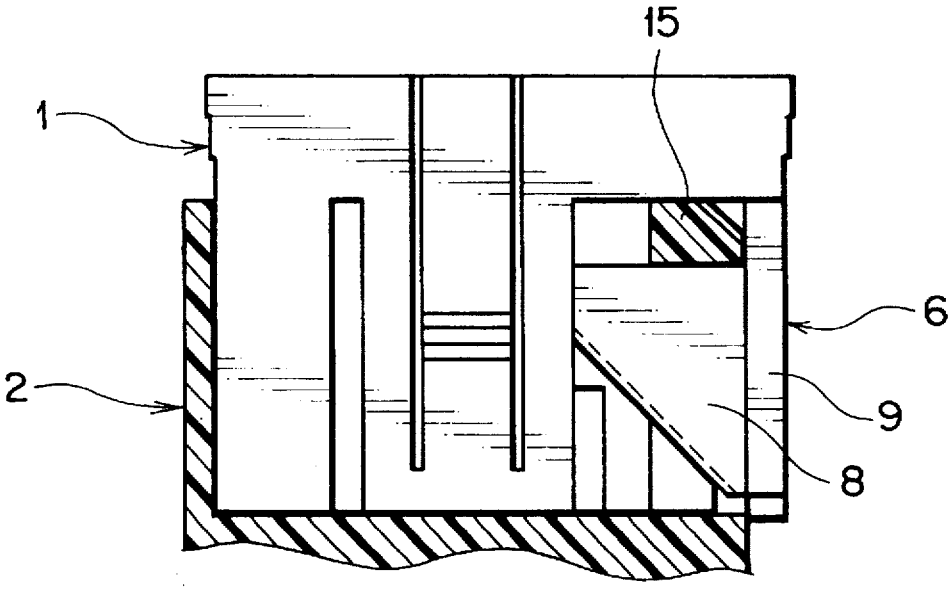
FIG. 9 is an explanatory illustration showing the pair of connector housings in the state that the coupling noticing member in FIG. 8 has been pushed into.
Figure 10:
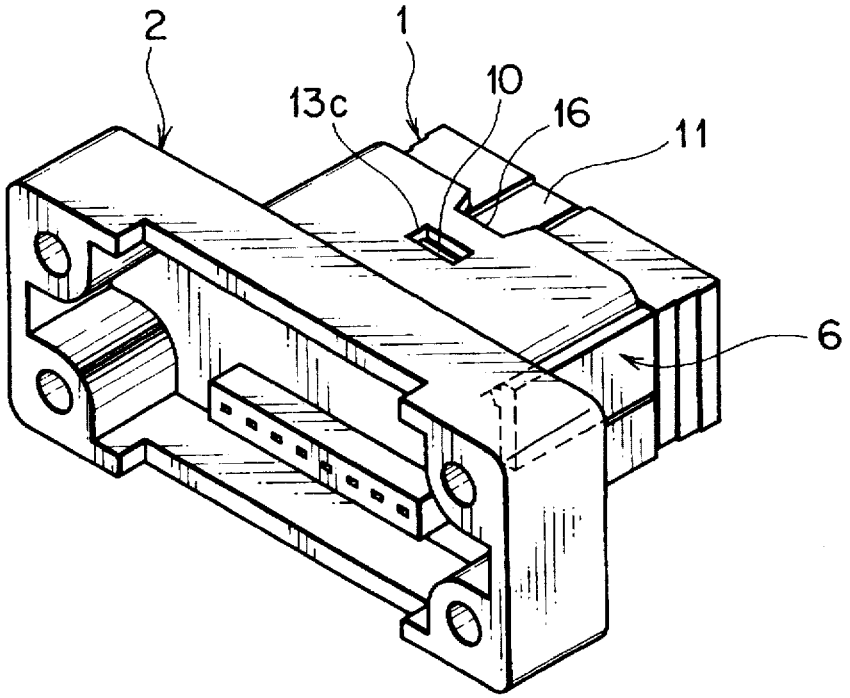
FIG. 10 is a perspective view showing the pair of connector housings in FIG. 9.

In this stage, the actuating portion 8 of the coupling noticing member 6, as shown in FIG. 8, has aligned with the inserting recess 14 in the hood portion 13 without intersecting with the projecting guide piece 15. Then, the operating portion 9 of the coupling noticing member 6, as shown in FIGS. 9 and 10, is pushed to draw the actuating portion 8 of the coupling noticing member 6 into the guiding channel 14.

Figure 11:
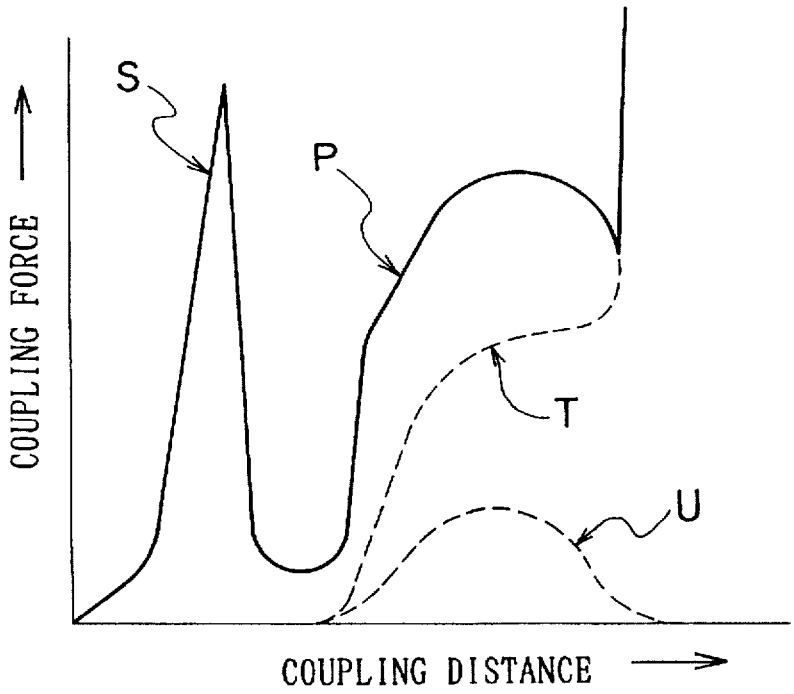
FIG. 11 is a graph showing the coupling force varying in the coupling process of the pair of connector housings in FIG. 1.

The amounts of the coupling force varying in the above-mentioned coupling process are shown in a graph in FIG. 11.

That is, the graph in FIG. 11 shows the varying amounts of the coupling force P for coupling the pair of connector housings 1, 2. The axis of abscissas shows coupling distances of the connector housing 1 to the connector housing 2 and the right end thereof corresponds to the complete engagement state. The axis of ordinate shows amounts of the coupling force.

In FIG. 11, the peak S of the coupling force P corresponds to an actuating force for actuating the coupling noticing member 6 mounted in the male connector housing 1. Then, the coupling force decreases during a period and increases when the male terminals 4 and the corresponding female terminals 12 received in the connector housing 1 or 2 begin to connect to each other.

As mentioned above, the coupling force P is the sum of the connection force (a dotted line T in FIG. 11) required for connecting the terminals 4, 12 accommodated in the pair of connector housings 1, 2 and a deflecting force (a dotted line U in FIG. 11) for deflecting the resilient lock arm 11.

That is, P=T+U

When the male connector housing 1 advances moreover into the female connector housing 2, the ramped locking protrusion 10 gets over the stepped portion 16 and the pair of the connector housings 1, 2 engages completely with each other, and the gradually increased coupling force P decreases since a pressing force to the resilient lock arm 11 is released. Accordingly, a worker can perceive by his hand the peak of the coupling force in the coupling process.

Figure 12:
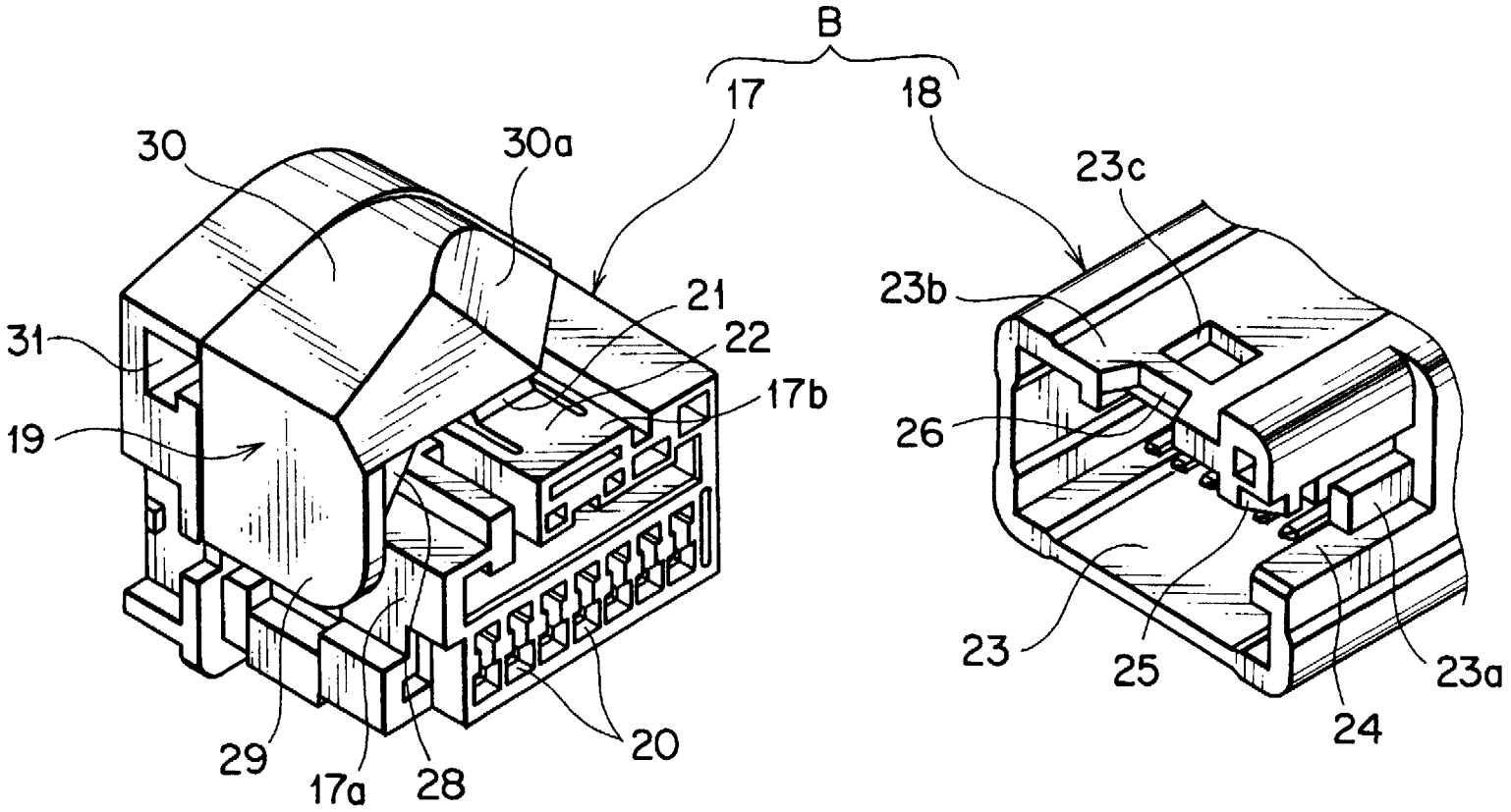
FIG. 12 is a perspective view showing an electrical connector assembly having a coupling guide structure in another embodiment according to the present invention.

FIG. 12 is a perspective view of an electrical connector assembly B in another embodiment according to the present invention.

Thee connector assembly B is composed of a male connector housing 17 having a coupling noticing member 19 and a female connector housing 18 coupled with the male connector housing 17, the connector housings having substantially the same structure as the connector housings 1, 2 in the electrical connector assembly A except the structure of the coupling noticing member 19 mounted therein.

That is, in the male connector housing 17 there are provided a plurality of terminal receiving cavities 20. In a side wall 17*a* of the connector housing 17, substantially orthogonally to the connector engagement direction, there is slidably mounted a coupling noticing member 19. On an upper wall 17*b* of the male connector housing 17 there is provided a resilient deflectable lock arm 22 having a ramped locking protrusion 21.

The female connector housing 18 has a hood portion 23 receiving the male connector housing 17. In a side wall 23*a* of the hood portion 23, an actuating portion inserting recess 24 for receiving an actuating portion of the coupling noticing member 19 when the connectors are coupled and a projecting guide piece 25 are formed by cutting out the side wall 23*a* of the hood portion 23.

In an upper wall 23*b* of the hood portion 23 there is formed a stepped portion 26 by opening a through hole 23*c* in the upper wall 23*b*.

Figure 13:
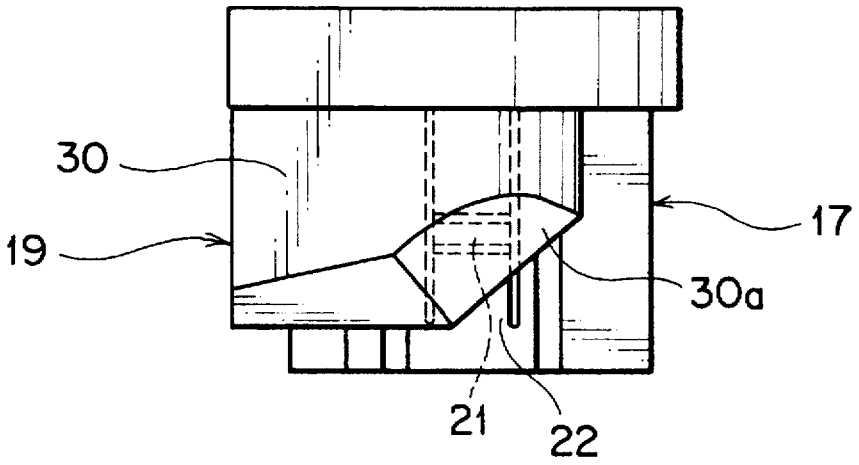
FIG. 13 is a top view of the male connector housing in FIG. 12.

The coupling noticing member 19 is provided with a rectangular plate-shaped sliding portion 27 and a substantially triangular plate portion 28 in a body (refer to FIGS. 14 to 16) in the same way as the coupling noticing member 6. Differing from the coupling noticing member 6, an operating portion 29 provided in the coupling noticing member 19, as shown in FIG. 13, has a lock portion for locking the male connector housing 17 including a resilient lock arm 22 with a ramped locking protrusion 21 and a covering portion 30 for covering the through hole 23*c* of the hood portion 23 and its periphery when the female connector housing 18 has engaged with the male connector housing 17.

The covering portion 30 is cantilevered from an upper end of the operating portion 29. The breadth of the covering portion 30 decreases gradually in the forward end thereof and has a slant face 30*a* oblique to the advancing direction of the coupling noticing member 19.

The sliding portion 27 of the coupling noticing member 19 is inserted into a coupling noticing member receiving recess 31 provided in the side wall 17*a* in the male connector housing 17. Thereby, the coupling noticing member 19 has been slidably mounted in the male connector housing 17 in the same way as the coupling noticing member 6 mentioned in the first embodiment.

Next, an engagement process of the pair of connector housings 17, 18 will be discussed.

Figure 14:
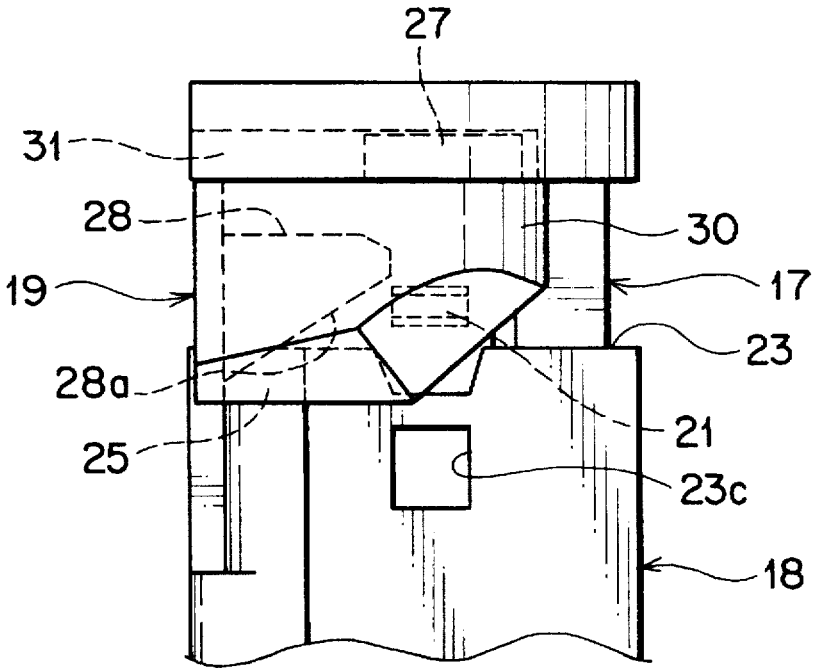
FIG. 14 is an explanatory illustration showing an initial engagement stage of the pair of connector housings in FIG. 12.
Figure 15:
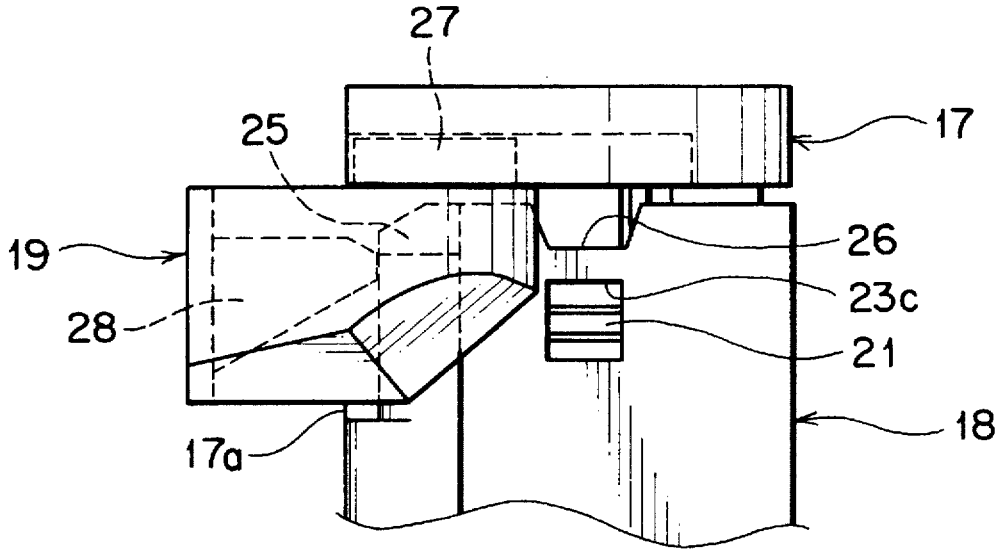
FIG. 15 is an explanatory illustration showing the state that a coupling noticing member has been pushed out along with the advanced engagement of the pair of connector housings in FIG. 14.

Referring to FIG. 14, when the male connector housing 17 enters into the hood portion 23 of the connector housing 18, the tapered face 28*a* of the actuating portion 28 in the coupling noticing member 19 abuts against the projecting guide piece 25 in the hood portion 23. As shown in FIG. 15, the advance of the male connector housing 17 makes the coupling noticing member 19 draw out from the side wall 17*a* of the male connector housing 17.

Meanwhile, the ramped locking protrusion 21 of the resilient lock arm 22 in the male connector housing 17 abuts against the stepped portion 26 in the female connector housing 18, so that the resilient lock arm 22 is bent to deflect downward.

When the male connector housing 17 advances moreover, the ramped locking protrusion 21 of the resilient lock arm 22 gets over the stepped portion 26 to be locked in the hole 23*c* and at the same time, the pair of connector housings 17, 18 engages completely with each other.

Figure 16:
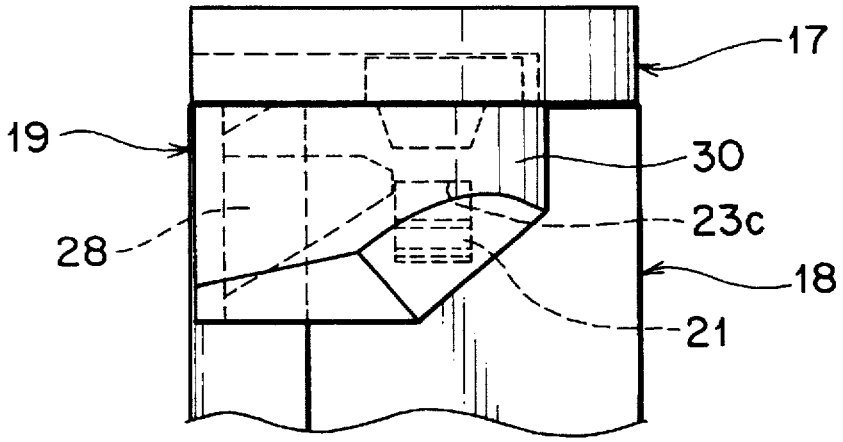
FIG. 16 is an explanatory illustration showing the state that the coupling noticing member in FIG. 15 has been pushed in and a covering portion has covered a lock portion in the pair of connector housings.
Figure 17:
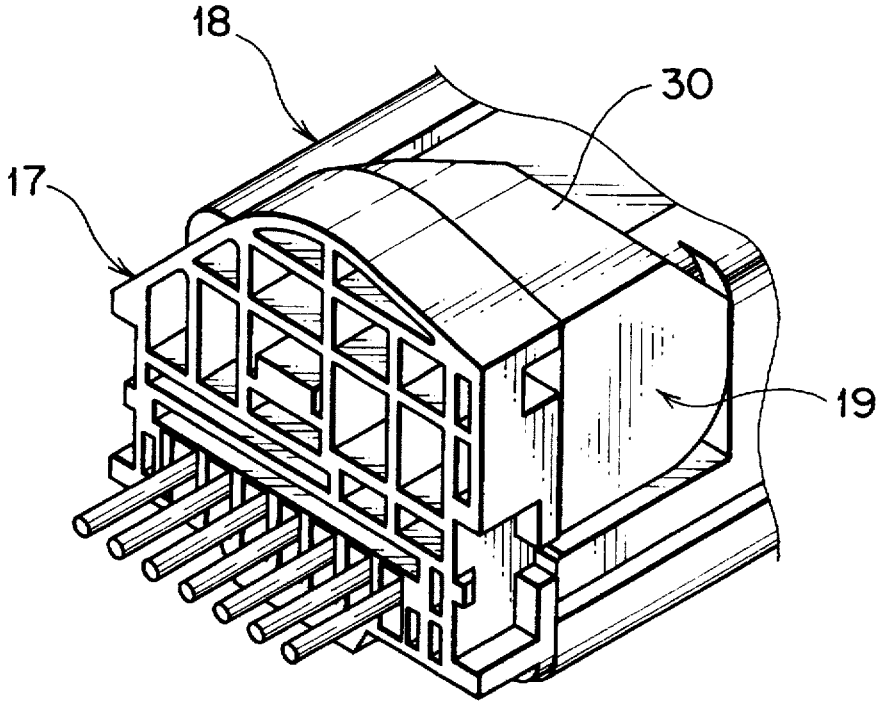
FIG. 17 is a longitudinal sectional view of the pair of connector housings in FIG. 12, in which the engagement is completed.
Figure 18:
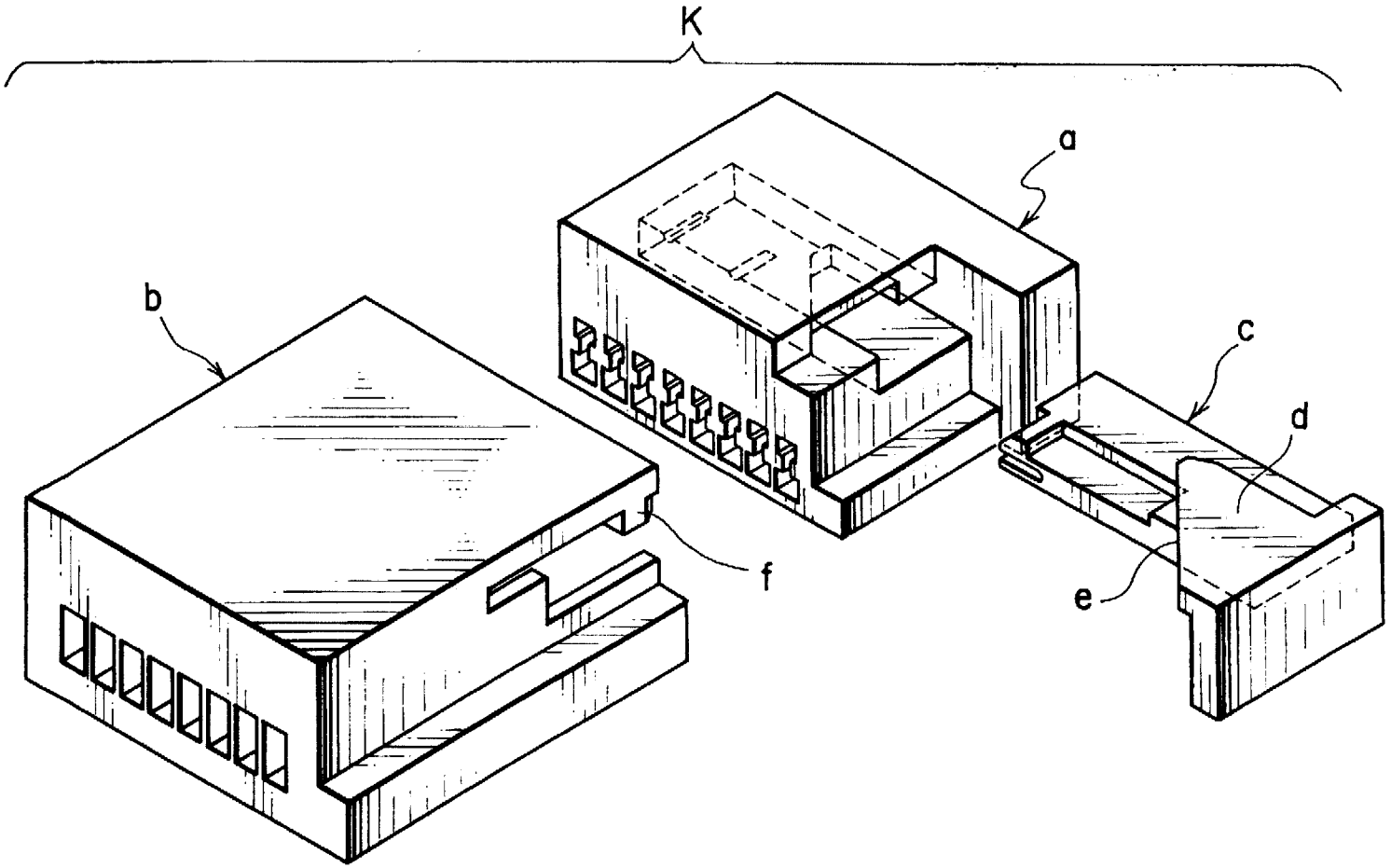
FIG. 18 PRIOR ART
FIG. 18 is a perspective view showing an electrical connector assembly having a conventional coupling guide structure.
Figure 19:
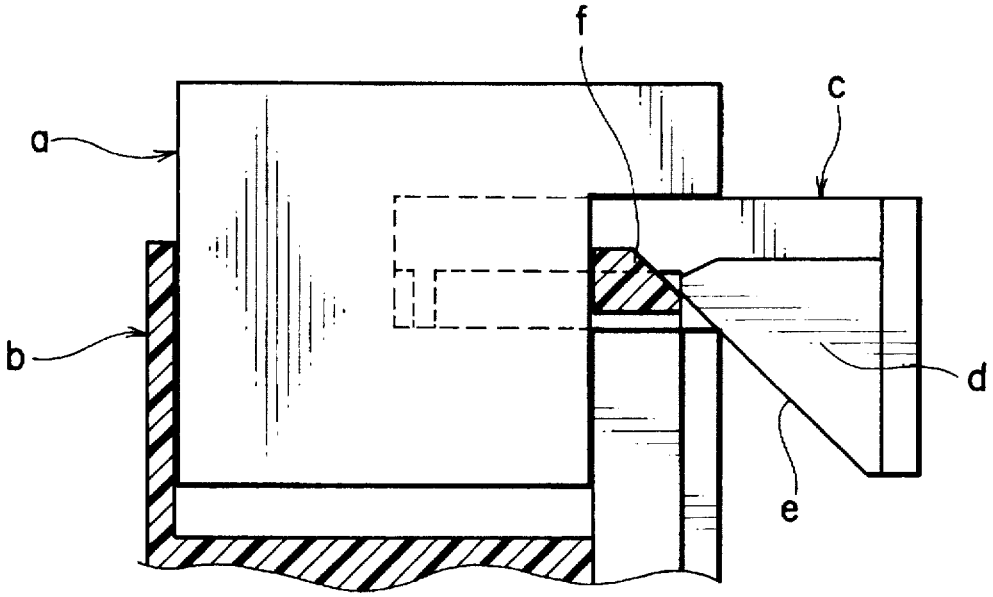
FIG. 19 PRIOR ART
FIG. 19 is an explanatory illustration showing a proceeded engagement state of the pair of connector housings in FIG. 18.
Figure 20:
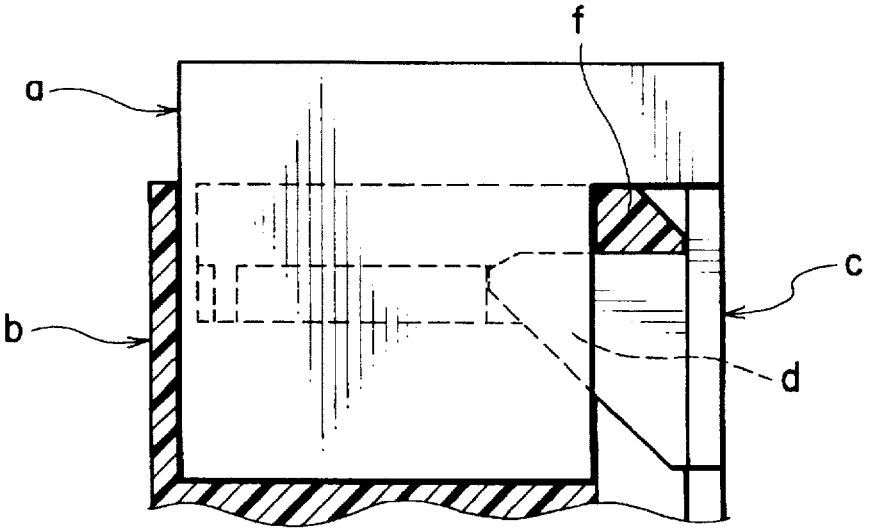
FIG. 20 PRIOR ART
FIG. 20 is an explanatory illustration showing the state that the pair of connector housings in FIG. 19 have been completely engaged with each other.
Figure 21:
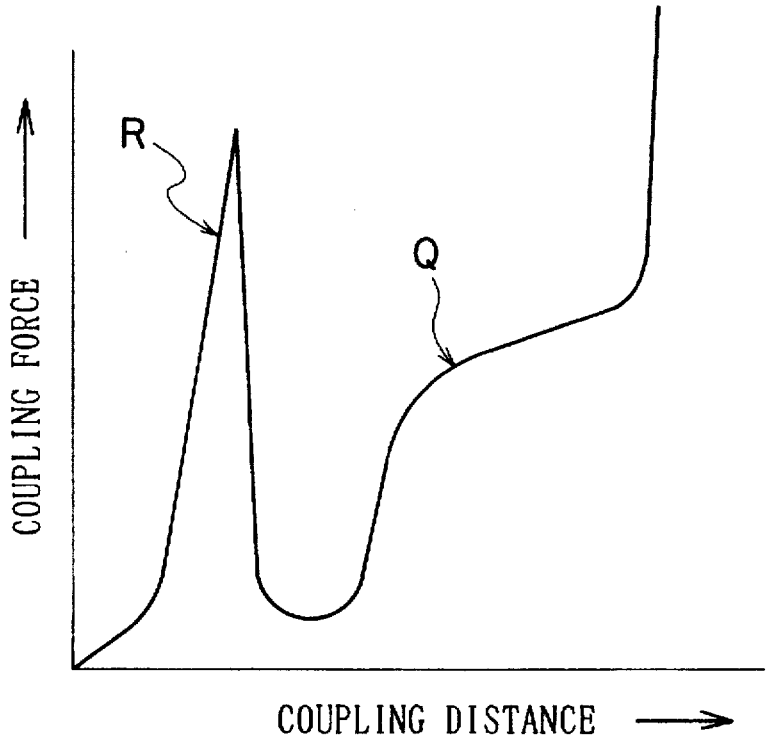
F I G. 21 PRIOR ART
FIG. 21 is a graph showing the coupling force varying in the coupling process of the pair of connector housings in FIG. 18.

In this stage, the actuating portion 28 of the coupling noticing member 19, as shown in FIG. 15, has positioned not to be stopped by the projecting guide piece 25. Then, the operating portion 29 of the coupling noticing member 19, as shown in FIGS. 16 and 17, is pushed to draw the actuating portion 28 of the coupling noticing member 19 into the female connector housing 18 and at the same time, the covering portion 30 in the coupling noticing member 19 covers the hole 23*c* in the hood portion 23 and the ramped locking protrusion 21 of the resilient lock arm 22.

Since the coupling noticing member 19 in the connector housing B has the covering portion 30, the covering portion 30 can protectively cover the lock portion for locking the male connector housings 17, 18 including the through hole 23*c* of the hood portion 23, the ramped locking protrusion 21 of the resilient lock arm 22, and their periphery when the pair of connector housings 17, 18 have engaged with each other.

Accordingly, an unintentional external force provided in the lock portion can not bring about a wrong operation and unfavorable materials will be prevented to enter from the through hole 23*c* of the hood portion 23.

Moreover, the slant face 30*a* in the covering portion 30 can guide an electric wire along the surface 30*a*, even when the wire has hooked the covering portion 30 in wiring works. Thereby, it eliminates the drawback that the wire is wound in a gap between the covering portion 30 and one of the connector housings 17, 18.

Now, operational effects of the present invention will be discussed in the followings. In the present invention, a first connector housing has a resilient lock arm with a ramped locking protrusion and a second connector housing has a stepped portion abutting against the ramped locking protrusion. Thereby, a worker can perceive a coupling force peak, that is, a coupling force changing from an increasing stage to a decreasing stage in coupling operation by his hand, when the ramped locking protrusion of the resilient lock arm gets over the stepped portion. Accordingly, the complete engagement in the pair of connector housings is surely confirmed with ease, which eliminates such a drawback as an incomplete engagement and provides advantages such as improved productivity and reliability.

What is claimed is:

1. An electrical connector assembly with a coupling guide structure comprising:

a first connector housing having a coupling noticing member slidably mounted in said first connector housing orthogonally to the connector housing coupling directions;

an operating portion provided in one outer end of said coupling noticing member; an actuating portion provided in said coupling noticing member and having an inwardly tapered face with a falling gradient, said tapered face being directed oppositely to the connector housing coupling direction;

a second connector housing being engageable with said first connector housing;

a projecting guide piece provided in an opening end of said second connector housing and abutting against said tapered face of said coupling noticing members; and an actuating portion inserting recess opened adjacent to said projecting guide piece in said second connector housing, wherein said first connector housing has a resilient lock arm with a ramped locking protrusion and said second connector housing has a stepped portion, said actuating portion of said coupling noticing member prevented from being fully inserted in said first connector housing by said projecting guide piece of said second connector housing while said ramped locking Protrusion of said resilient lock arm is abutting against said stepped portion, said coupling noticing member being able to be fully inserted in said first connector housing when said ramped locking protrusion of said resilient lock arm has ridden over said stepped portion.

2. An electrical connector assembly with a coupling guide structure as claimed in claim 1, wherein said ramped locking protrusion has a forward tapered face and a rearward tapered face in the connector coupling direction.

3. An electrical connector assembly with a coupling guide structure as claimed in claim 1, wherein said coupling noticing member has a covering portion for covering a lock portion including said ramped locking protrusion projecting for locking the first and second connector housings to each other.

4. An electrical connector assembly with a coupling guide structure as claimed in claim 3, wherein said covering portion of the coupling noticing member has a tapered outer surface descending obliquely to the advancing direction of said coupling noticing member.

5. An electrical connector assembly with a coupling guide structure as claimed in one of claims 1 to 4, wherein said second connector housing has a through hole with which said ramped locking protrusion is engaged, when said ramped locking protrusion has gotten over said stepped portion along with the coupling completion of the pair of connector housings.

* * * * *